United States Patent [19]

Stamp

[11] 4,364,728

[45] Dec. 21, 1982

[54] CONTINUOUS STRIP PREHEAT FURNACE AND METHOD OF OPERATION

[75] Inventor: Donald F. Stamp, North Benton, Ohio

[73] Assignee: The Electric Furnace Company, Salem, Ohio

[21] Appl. No.: 265,153

[22] Filed: May 19, 1981

[51] Int. Cl.[3] ..... F27B 9/28; F27D 1/18; C21D 9/52; C21D 9/54

[52] U.S. Cl. ..... 432/8; 266/102; 266/103; 432/59; 432/250

[58] Field of Search ..... 432/8, 59, 250; 266/102, 103

[56] References Cited

U.S. PATENT DOCUMENTS

| | | | |
|---|---|---|---|
| Re. 28,168 | 9/1974 | Cope et al. | 432/59 |
| 3,469,826 | 9/1969 | Berkehile | 432/59 |
| 3,532,329 | 10/1970 | Bloom | 432/59 |
| 3,837,790 | 9/1974 | Pierson | 432/8 |
| 4,148,946 | 4/1979 | Byrd et al. | 432/8 |
| 4,160,641 | 7/1979 | Miskololczy et al. | 432/59 |
| 4,165,964 | 8/1979 | Yonezawa et al. | 432/59 |
| 4,243,441 | 1/1981 | Wilson | 432/8 |

*Primary Examiner*—John J. Camby

*Attorney, Agent, or Firm*—Meyer, Tilberry & Body

[57] ABSTRACT

A continuous strip preheat furnace and method of operation is disclosed wherein the furnace is provided with fired and unfired sections, separate exhaust stacks operably secured to each section, and means to regulate the flue gases which pass through the separate exhaust stacks to improve the operating efficiency of the furnace. The fired and unfired sections may both be vertical or horizontal, or one may be vertical and the other horizontal.

23 Claims, 11 Drawing Figures

CONTINUOUS STRIP PREHEAT FURNACE AND METHOD OF OPERATION

BACKGROUND OF THE DISCLOSURE

This invention pertains to the art of continuous metal strip annealing and, more specifically, to the art of preheating furnaces which are adapted to clean and to preheat the strip prior to a subsequent further treating in an annealing furnace. In particular, this invention pertains to the class of preheating furnace used in continuous steel strip non-ferrous metal coating processes such as employed in galvanizing and aluminum coating lines.

The lengths of the pass lines in preheating and annealing furnaces are a function of the temperatures of the respective furnaces and of the speed of the strip passing through these furnaces. It is customary in the prior art for a preheat furnace to receive strip at ambient temperature and to preheat it to within a few hundred degrees of the desired annealing temperature. The strip then passes into the annealing furnace, which is of sufficient length to bring the strip up to full annealing temperature and to perform the desired annealing operation on the strip. Thus, the longer the annealing furnace pass line, the more time is available to bring the strip up to full annealing temperature. However, if space considerations require that the annealing furnace be shortened, then this may be compensated for by increasing the temperature of the strip to more closely approximate the annealing temperature before it leaves the preheat furnace. The disadvantage of higher operating temperatures in preheat furnaces is that the life of the ceramic insulation is foreshortened by the higher temperature at which the furnace is operated.

Experience in operating preheat and annealing furnaces has developed certain accepted optimum operating temperatures for preheat furnaces and for annealing furnaces, taking into consideration the various compromises which must be made to obtain reasonable efficient furnace operation. By operating the preheat furnace substantially within a range of from 2200° F. to 2400° F., with a pass line of sufficient length, the exit temperature of the strip may be regulated to substantially 1000° F. At this temperature the strip passes into the annealing furnace where it is further elevated a few more hundred degrees to the desired annealing temperature and held at that temperature for the required length of time before exiting the annealing furnace for further processing.

Considering the preheat furnace and the annealing furnace as a unit, these furnaces are traditionally designed for constant tonnage production. Constant tonnage is used in the context that at optimum strip line speed and with optimum furnace operating temperatures, the furnaces are capable of heat treating a predetermined maximum number of tons of steel per hour. However, such operation is generally limited within a range of strip thickness gauges in that, if the strip is over a certain gauge the furnace will not be able to heat the strip to the required temperature within the required time. Conversely, if the strip is below a certain specified gauge then the furnace is incapable of moving the strip through the furnace fast enough to keep pace with the heating capacity of the furnace. Accordingly, it has been customery to have different sizes of furnaces designed to process steel strip within specified gauge ranges. Thus, furnaces designed to process very narrow gauge strips would usually be incapable of efficiently handling the higher gauge strips. It also follows, therefore, that furnaces designed to process higher gauge strips cannot efficiently process narrow gauge strips.

SUMMARY OF THE INVENTION

The invention herein described provides a preheat furnace having the capacity for processing a much wider range of strip gauges than heretofore practical in a single preheat furnace, while at the same time operating at greater efficiency than similar prior art preheat furnaces. To achieve this improved furnace operation, the furnace is provided with a pair of exhaust stacks that are regulated and coordinated in a novel manner. In a preferred embodiment of the invention, a vertical exhaust stack is connected at its lower end to the lower end of an unfired vertical preheat section or chamber of a preheat furnace. The unfired preheat section is in turn connected at its upper end to the upper end of a fired vertical preheat section. Also secured to the upper end of the fired preheat section is a second exhaust stack. The lower end of the fired preheat section is connected to the entrance to the annealing furnace. With this general arrangement, the strip enters the lower end of the unfired preheat section, moves vertically upwardly over rolls, and then downwardly through the fired preheat section and then into the annealing furnace. The flue gases from the fired preheat section enter the unfired preheat section through a cross-over tunnel connecting the upper ends of the unfired and the fired sections.

In one mode of operation, the flue gases pass downwardly through the unfired preheat section and then upwardly through the first flue gas exhaust stack. In another mode of operation, the first flue gas exhaust stack is closed and the flue gases are directed through the second flue gas stack. In yet another mode of operation, flue gases are directed through both flue gas exhaust stacks. By use of a combination of dampers and tight shutoff flue covers or seals the temperature of the strip passing through the unfired and fired preheat sections is closely controlled so that a wider range of gauges may be accommodated in this preheat furnace wherein the exit temperature of the strip is the same for the same residency time in the preheat furnace irrespective of the gauge of the strip. Although the vertical preheat furnace just discussed is a preferred embodiment of the invention, the invention also contemplates horizontal preheat furnace embodiments as well as preheat furnaces having both vertical and horizontal sections.

OBJECTS OF THE INVENTION

It is a principal object of the invention to provide a preheat furnace having an unfired preheat section and a fired preheat section, and means for controlling the flow of flue gases from the first preheat section to the unfired preheat section, including the use of dual exhaust stacks.

It is another object of this invention to provide a combination of dual damper means whereby the flow of flue gases from the fired preheat section to the unfired preheat section may be closely controlled.

It is a further object of this invention to provide a flue gas exhaust means from both the unfired preheat section and the fired preheat section.

It is yet another object of this invention to provide improved means for sealing off the exhaust means associated with the fired and unfired preheat sections.

It is yet an additional object of this invention to provide means of operating a preheat furnace in a manner wherein the overall efficiency of the operation of the furnace is increased.

It is yet still another object of the invention to provide a preheat furnace in which the heat from the flue gases generated in a fired preheat section are used to preheat the strip in an unfired preheat section, thereby recovering a considerable percentage of the heat of the flue gases before they are vented to atmosphere.

It is also another object of the invention to provide means between the unfired preheat section and the fired preheat section to compensate for expansion due to differential temperatures in the respective sections.

These and other objects will become apparent by referring to the following specification and drawings.

DESCRIPTION OF PREFERRED EMBODIMENTS OF THE INVENTION

Introduction

The ultimate test of whether a preheat furnace in a non-ferrous coating line is performing its function properly is whether the coating properly adheres to the surface of the steel strip after it has been passed through the molten non-ferrous coating bath. If the adherence of the coating to the strip is erratic, the problem could be that the temperature of the unfired preheat section of the furnace requires adjusting. When passing the strip through the unfired preheat section there is a possibility that the residual oil on the strip could be so baked on the strip that it would not be removable by the open flame burners in the fired preheat section. It is also a possibility that the strip could oxidize in the unfired preheat section if the residence time in this section is too long. Even slight oxidation of the strip is another cause for imperfect bonding between the coating and the strip. When problems of this type occur, it has been found that, by adjusting the flow of flue gases from the fired preheat section to the unfired preheat section of the furnace, these problems can be corrected. Accordingly, it is an aspect of this invention that sensors are used to detect the temperature of the strip, and in particular in the tunnel housing the cross-over rolls leading the strip from the unfired section to the fired section of the furnace. Depending on the temperatures sensed, various adjustments may be made to the flow of the flue gases, as will be described in greater detail hereinbelow.

Detailed Discussion of the Drawings

Figure 1:
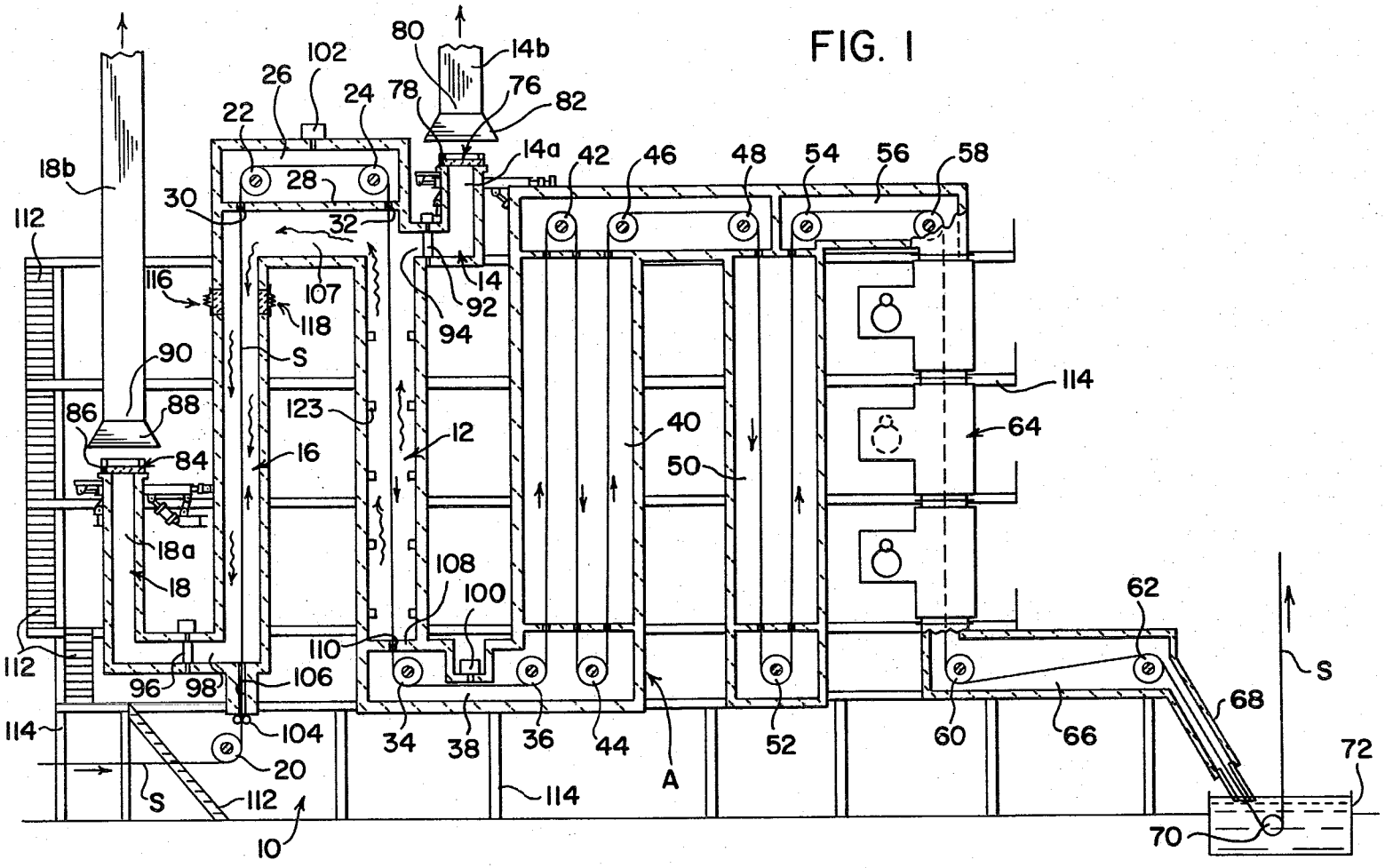
FIG. 1 is a schematic elevational view in section of a preferred embodiment of the invention shown in association with a companion annealing furnace.

Referring now more specifically to the Figures, wherein like parts will be designated by like numerals, and, in particular to FIG. 1, it will be seen that the preheat furnace 10 comprises four principal components including a fired preheat section 12, a flue gas exhaust stack 14, an unfired preheat section 16, and a flue gas exhaust stack 18. Strip guide rolls 20 and 22 guide the strip S upwardly along a vertical pass line through the unfired preheat section 16. Guide rolls 22 and 24 guide the strip along a horizontal pass line through an enclosed cross-over tunnel 26, which has a lower partition or baffle 28 with openings 30 and 32 to permit movement of the strip into and out of the cross-over tunnel 26. Guide rolls 24 and 34 guide the strip downwardly along a vertical pass line through the fired preheat section; rolls 34 and 36 guide the strip horizontally through a lower cross-over tunnel 38 into the first pass zone 40 of the annealing furnace A, wherein guide rolls 36 and 42 guide the strip upwardly through the first of several passes within the annealing furnace. Thereafter, guide rolls 44, 46 and 48 guide the strip into an air cooling tube 50. Guide rolls 48, 52 and 54 guide the strip through the air cooling tube 50 and into cross-over tunnel 56. Guide rolls 58, 60 and 62 guide the strip through a jet cooling chamber 64, connecting tunnel 66, molten metal pot snout 68 and around guide roll 70 beneath the surface of the molten metal in a pot 72. Thereafter, the strip is directed out of the molten metal pot 72 for further processing, such as cooling, shearing, rewinding and the like.

Referring again to the preheat furnace 10, in FIG. 1, it will be seen that exhaust stack 14 is bifurcated to provide a lower exhaust duct **14*a* and an upper exhaust duct 14*b*. The upper end of exhaust duct 14*a* is provided with a tight shutoff flue cover 76 which may be shifted laterally out of engagement with the upper periphery 78 of exhaust duct 14*a*. The lower end 80 of exhaust duct 14*b* is provided with a hood 82 which assists the ingress of air into exhaust duct 14*b* to cool the entering flue gases and thereby prolong the life of the insulation of the upper exhaust duct 14*b***.

In like manner, exhaust stack 18 is bifurcated to provide a lower exhaust duct **18*a* and an upper exhaust duct 18*b*. A tight shutoff flue cover 84 is provided to seal the upper end 86 of lower exhaust duct 18*a* by being shifted laterally into engagement with upper exhaust duct periphery 86. A hood 88 is secured to the lower periphery 90 of upper exhaust duct 18*b* also for the purpose of permitting easy ingress of air to mix with and cool the exhaust gases entering exhaust duct 18b thereto to prolong the life of the insulation lining of exhaust duct 18b**.

A damper 92 is positioned in throat 94 connecting fired preheat section 12 with exhaust stack 14. A second damper 96 is positioned in throat 98 connecting exhaust stack 18 with unfired preheat section 16. A strip temperature sensor 100 is positioned in cross-over tunnel 38 to sense the temperature of the strip S as it leaves the fired preheat section 12. A second strip temperature sensor 102 is located in cross-over tunnel 26 to sense the temperature of the strip upon leaving the unfired preheat section 16.

In operation of a preheat furnace, in a galvanizing line for instance, it is important that air be excluded from the interior of the furnace. For this reason, the preheat furnace 10 is maintained at a pressure slightly above atmospheric, in the order of 0.3 to 0.5 inches of water column. Also, sealing rolls 104 are provided at the exterior end of elongated throat 106 to assist in excluding air from the preheat chambers. A cross-over tunnel 107 connects the upper ends of the fired and unfired preheat sections 12 and 16, respectively, and partition or baffle 28 is provided to protect the guide rolls 22 and 24 from overheating due to the passage of flue gases from the fired preheat chamber 12, through cross-over tunnel 107 and into unfired preheat chamber 16. A partition 108 separates the fired preheat section 12 from cross-over tunnel 38, except for a throat 110 provided to permit passage of the strip S from the fired preheat chamber 12 into the cross-over tunnel 38. Because a preferred embodiment of the preheat furnace may extend vertically from fifty to a hundred feet, metal staircases 112 and associated structural framework 114 are provided for furnace support, maintenance and furnace operation purposes.

Damper and tight shutoff flue cover operations are controlled from a furnace operator's control panel which is not necessarily located in the vicinity of the preheat furnace. The operator's control panel is standard in the art, and does not constitute part of this invention. However, it is well understood by those skilled in the art that various electrical, electronic, hydraulic and pneumatic control means to actuate the dampers and tight shutoff flue covers are centralized in the operator's control panel, wherein means are provided to operate the dampers and tight shutoff flue covers in accordance with the teachings of this disclosure.

Figure 6:
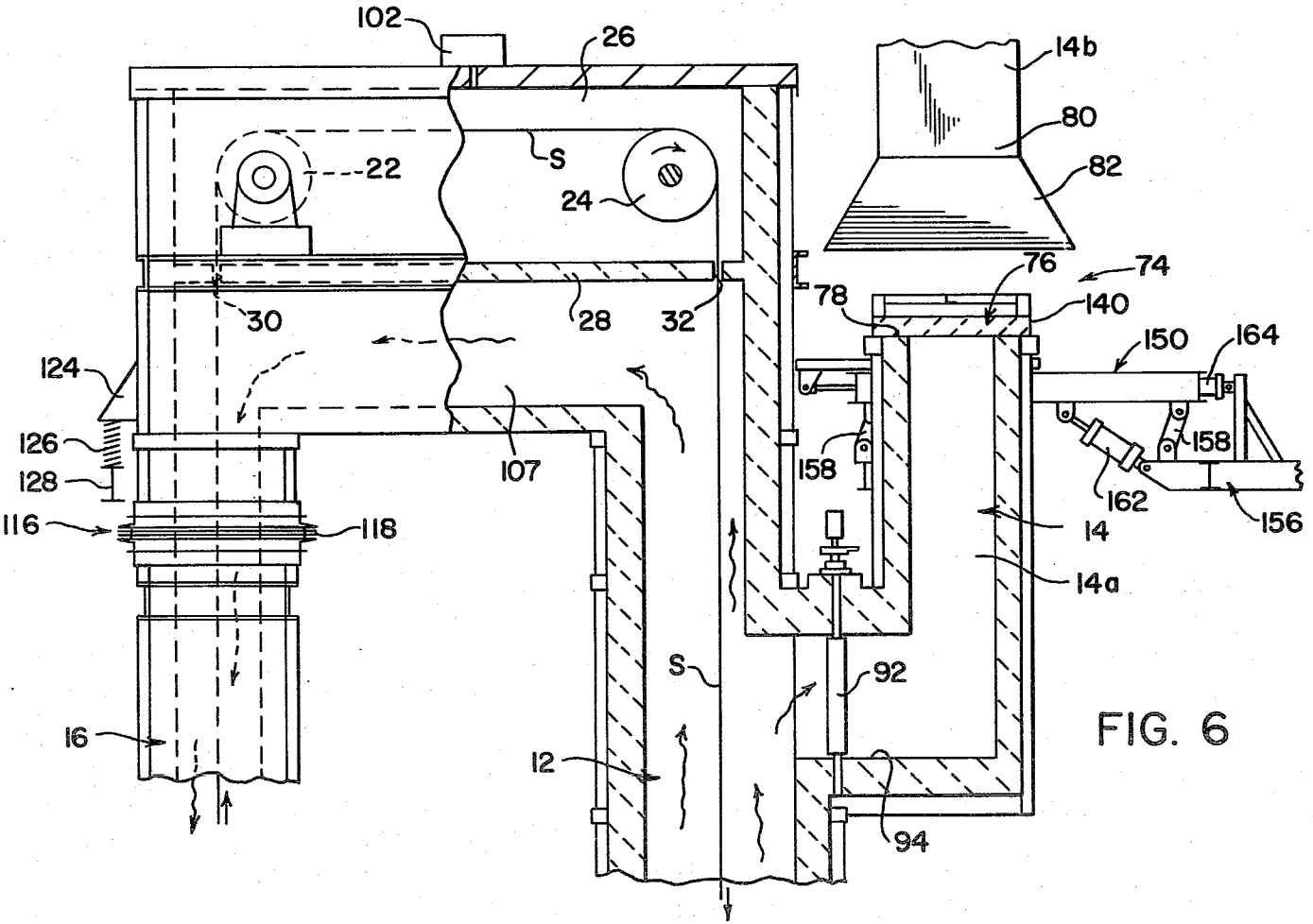
FIG. 6 is a fragmentary enlarged elevational view of the upper portion of the subject invention shown in FIG. 1.
Figure 7:
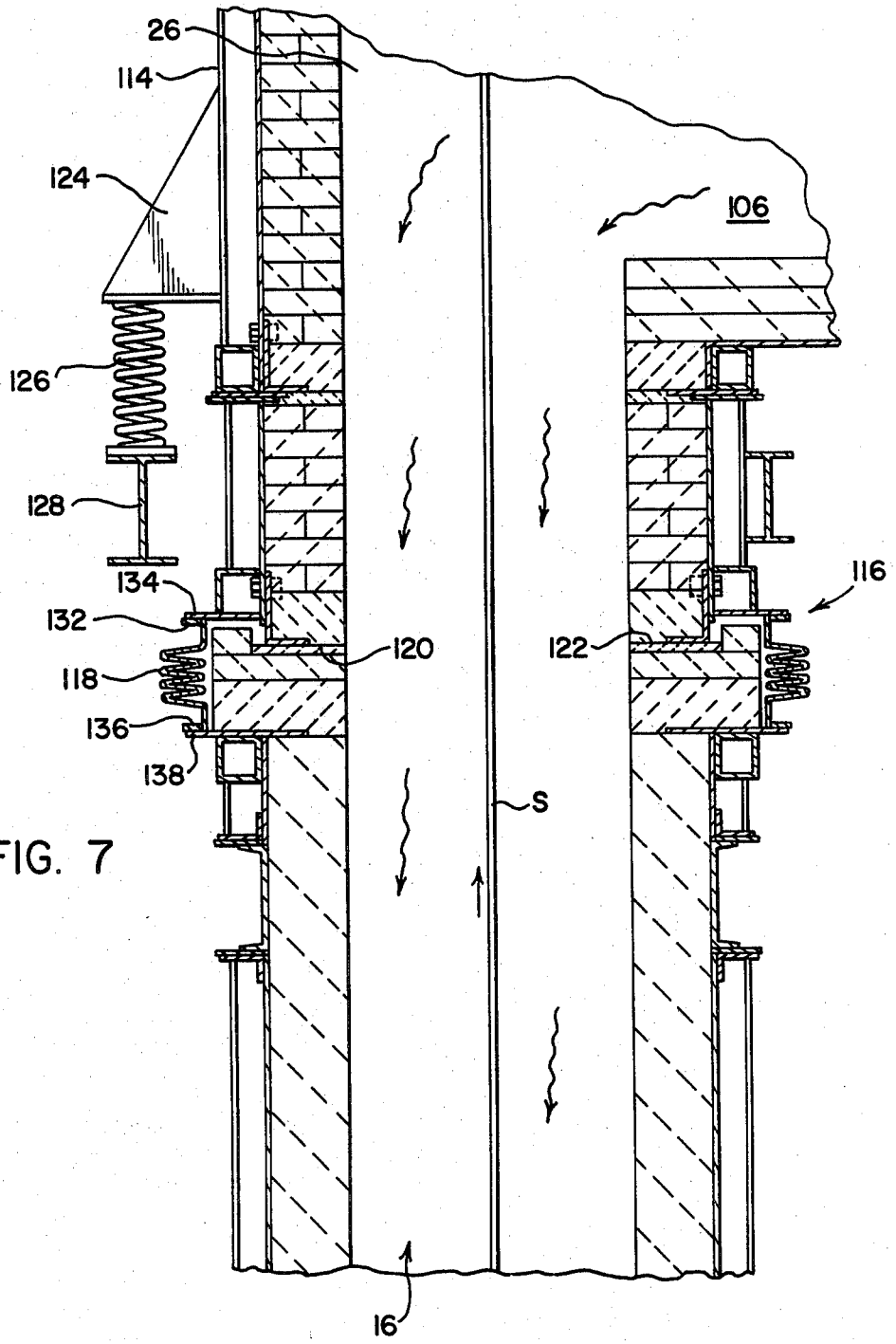
FIG. 7 is an enlarged fragmentary view of the expandable connecting means between the unfired section and the fired section of a preferred embodiment of the invention.

The fired preheat section 12 is normally operated within a temperature range substantially between 2200° F. and 2400° F. The flue gases pass over into the unfired preheat section 16 at approximately these temperatures and exit the unfired preheat section at approximately 1000° F. Thus, the average temperature of the preheat section 16 would be approximately 1600° F. to 1700° F., whereas the temperature of the fired preheat section 12 would be between 2200° F. and 2400° F. In view of the temperature differential between these two preheat sections of approximately six to seven hundred degrees Fahrenheit, the fired preheat section will expand to a greater overall length than will the unfired preheat section. To accommodate for this differential expansion, the preheat furnace 100 is bifurcated at 116 and joined together by an expandable bellows-type sleeve 118. As better shown in FIG. 6, roll housing cross-over tunnel 26 and flue gas cross-over tunnel 107 are rigidly secured to and are integral with the upper end of fired preheat chamber 12. Tunnels 26 and 107 are also cantilevered horizontally from fired chamber 12 to position the lower exit end 120 of tunnel 107 over the upper end 122 of unfired preheat chamber 16. See FIG. 7. Respective ends 120 and 122 are shown in abutting contact with each other, a condition encountered only when the temperature in each section is the same.

To support the weight of the cantilevered portion of cross-over tunnels 26 and 107, heavy duty gussets 124 are welded to the exterior frame structure 114 of the lower end of cross-over tunnel 107. Heavy duty springs 126 are positioned between the lower surface of gusset 124 and an I-beam 128 integral with the upper structure 114 of the furnace. So positioned, springs 126 carry the weight of the cantilevered portion of cross-over tunnels 26 and 107 so that no support of tunnels 26 and 107 is required by the upper end 122 of unfired section 16. With this structure, as fired chamber 12 expands vertically, responsive to the heat from the burners 123, bellows 18 will compensate for this expansion by permitting the cross-over tunnels 26 and 107 to move upwardly a greater distance than the expansion of the unfired chamber 16. It will be observed that the bellows upper perimeter flange 132 is secured and sealed to plate member 134 of cross-over tunnel 107 whereas the lower perimeter flange 136 of bellows 118 is secured and sealed to the plate member 138 of unfired preheat chamber 16. Thus, bellows 118 not only provides for differential vertical expansion between fired preheat section 12 and unfired preheat section 16, it also seals this portion of the furnace from the atmosphere irrespective of the displacement between the lower end of cross-over tunnel 107 and the upper end of unfired preheat section 16.

Reference is now made to FIGS. 2, 3, 4 and 5 which illustrate a preferred embodiment of the tight shutoff flue covers 74 and 84. These flue covers each comprise a rectangular frame 140 of welded structural steel members adapted to encase insulation of the type sufficient to withstand the flue gas temperatures experienced in exhaust stacks 14 and 18. The frame 140 is provided with stanchions 142 extending downwardly therefrom. The lower extremities of the stanchions are provided with flanged track wheels 144 adapted to ride on the lower flanges of channel members 146 spaced below and on opposite sides of flue cover frame 140.

Figure 5:
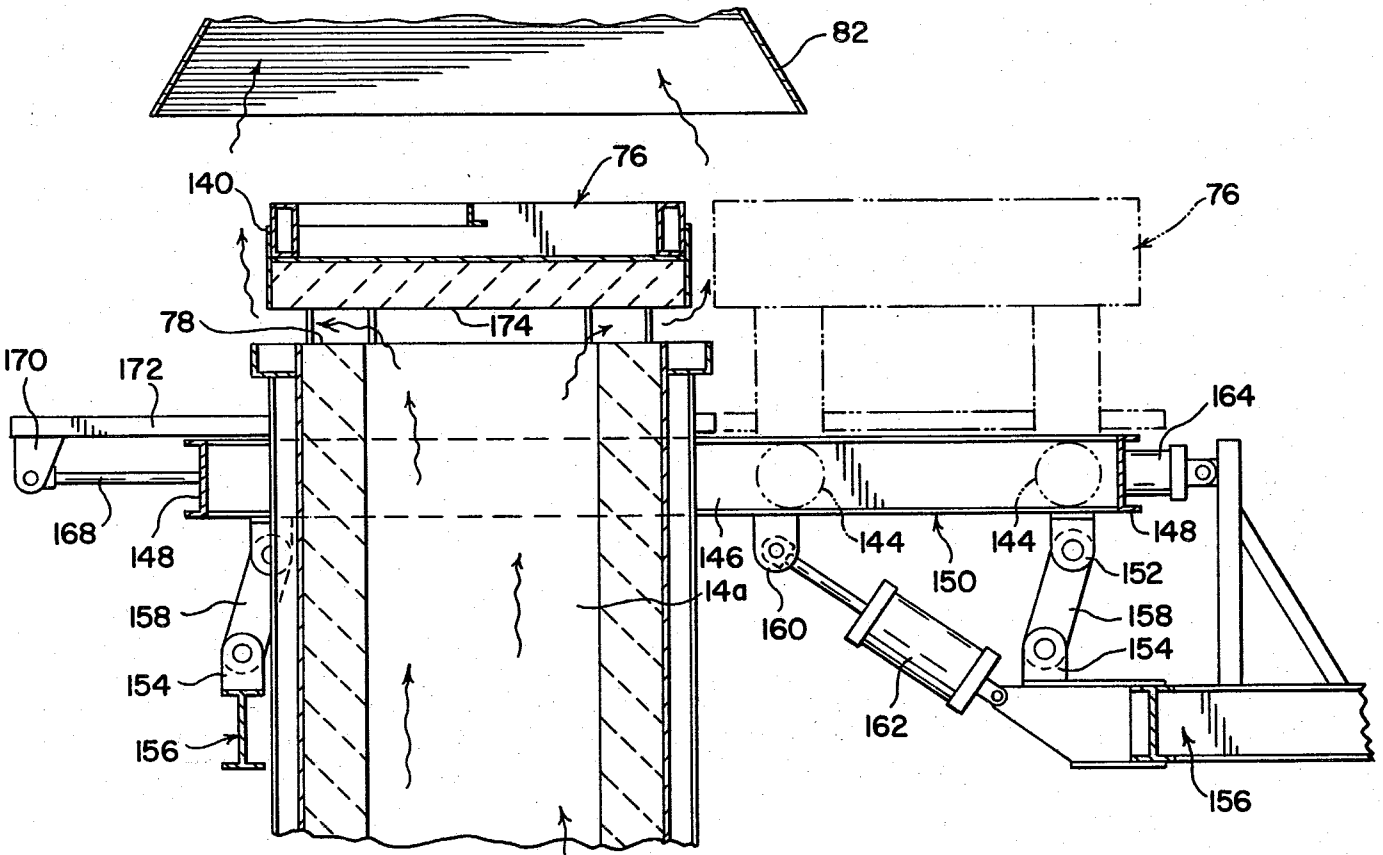
FIG. 5 is a partial side elevational view of the tight shutoff flue cover operating mechanism taken along the line 5—5 of FIG. 4.

Cross channel members 148 are secured to the opposite ends of channel members 146 to provide a second rectangular frame 150. Each of the four corners of rectangular frame 150 has a pair of spaced apart lugs 152 secured to the underside thereof. Matching pairs of spaced apart lugs 154 are coplanar with matching lugs 152 and are rigidly secured to the upper surfaces of structural channel members 156. Link members 158 have their opposite ends pivotally secured between pairs of lug members 152 and 154. Spaced apart lug members 160 are also secured to the underside of frame 150 intermediate lug members 152. A fluid power cylinder 162 on each side of frame 150 is pivotally secured between lug members 160 and structural member 156 and is so adapted that actuation of power cylinder 162 will cause link members 158 to pivot arcuately to lift and to lower frame 150. Fluid power cylinders 164 are also positioned on opposite sides of the flue cover with their cylinder casing ends 166 secured to a structural member 157. The piston 168 of each cylinder is secured at its free end to a lug 170 projecting downwardly from horizontal extension member 172. Channel members 146 are positioned adjacent each side of the upper ends 78 and 86 respectively of exhaust flue ducts 14*a* and 18*a* and extend from left to right, as shown in FIG. 5, a sufficient distance to permit the tight shutoff flue covers 76 and 84 to be shifted horizontally clear of the said upper ends 78 and 86, respectively.

Figure 2:
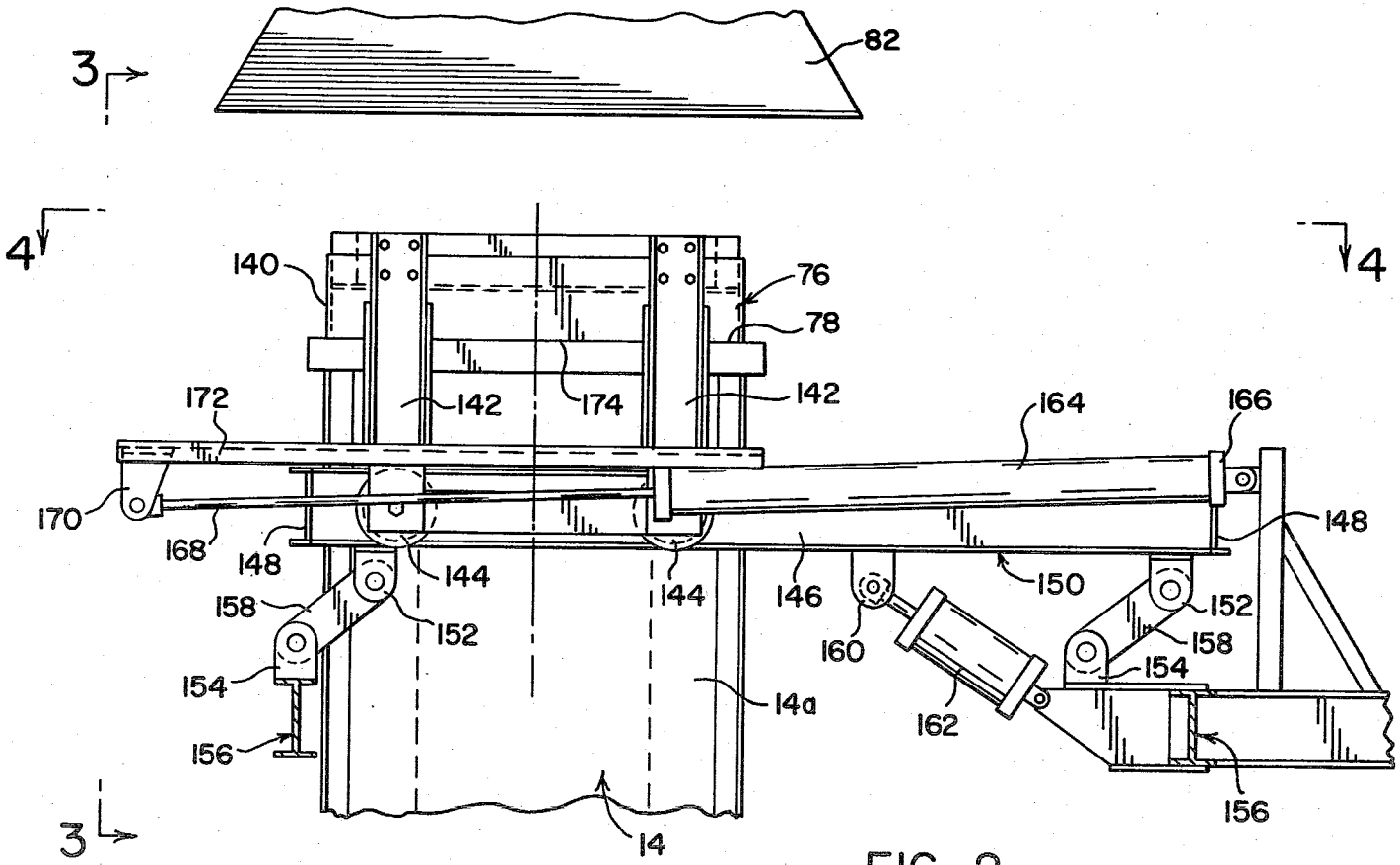
FIG. 2 is an elevational side view of a tight shutoff flue cover shown in the closed position as used in the subject invention.
Figure 3:
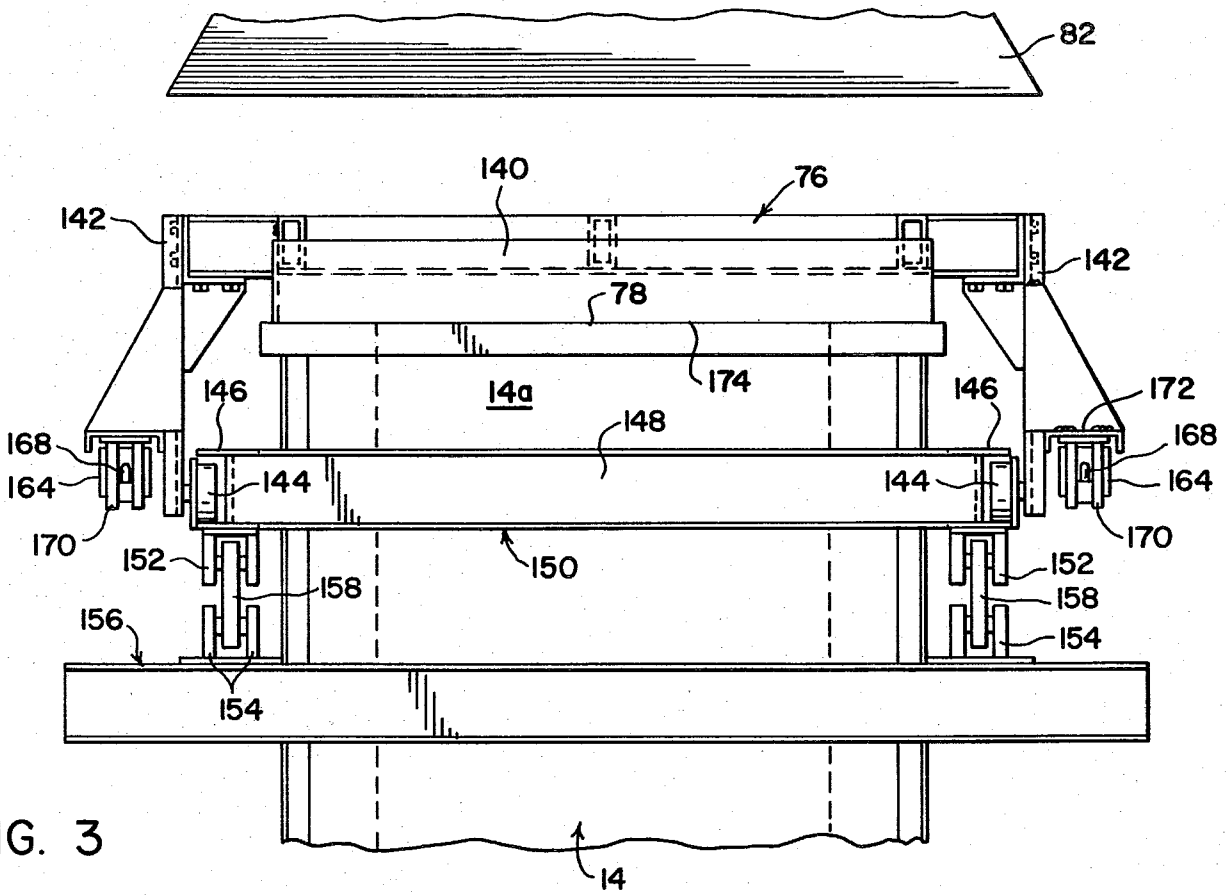
FIG. 3 is an elevational end view of the tight shutoff flue cover shown in FIG. 2, taken along the line 3—3 of FIG. 2.
Figure 4:
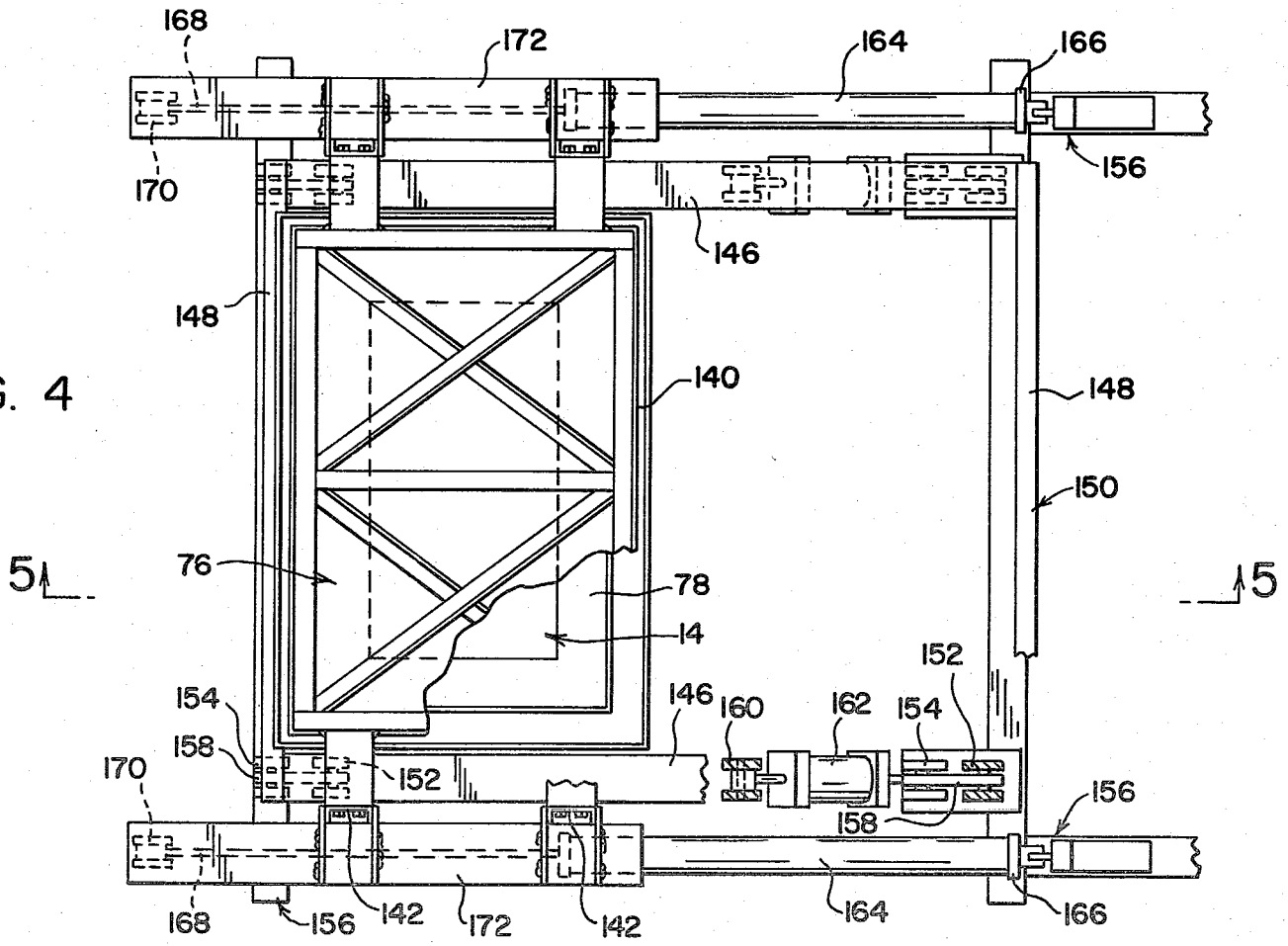
FIG. 4 is a plan view of the tight shutoff flue cover shown in FIG. 2, taken along the line 4—4 of FIG. 2.

Both flue covers 76 and 84 operate in exactly the same manner. Referring to tight shutoff flue cover 76, therefore, for illustrative purposes only, in operation, assume the tight shutoff flue cover 76 to be clear of exhaust duct end 78, as shown in phantom in FIG. 5. When it is desired to close the exhaust duct 14*a*, fluid power cylinders 164 are actuated to extend pistons 168, thereby causing the flue cover to be transversed laterally from right to left on wheels 144 tracking on channel members 146. When the tight shutoff flue cover 76 is positioned directly over the upper end 78 of exhaust flue gas 14*a*, cylinders 164 are deactivated and fluid power cylinders 162 are energized to pivot links 158 arcuately downwardly in a clockwise direction, as best shown in FIGS. 2 and 5, until the bottom surface 174 of tight shutoff flue cover 76 makes sealing contact with the upper perimeter 78 of flue gas exhaust stack 14*a*. To unseal exhaust stack 14*a*, the reverse process is undertaken whereby power cylinders 162 are actuated to arcuately pivot links 158 upwardly in a counterclockwise direction, thereby lifting cover 76 upwardly and clear of upper end 78 of exhaust duct 14*a*. Power cylinders 164 are again reactivated whereby pistons 168 are retracted into the cylinder housing 164, causing the flue cover 76 to shift horizontally from left to right. With this mechanism, the flue covers 76 and 84 may be readily shifted between the fully closed and fully opened positions.

Figure 8:
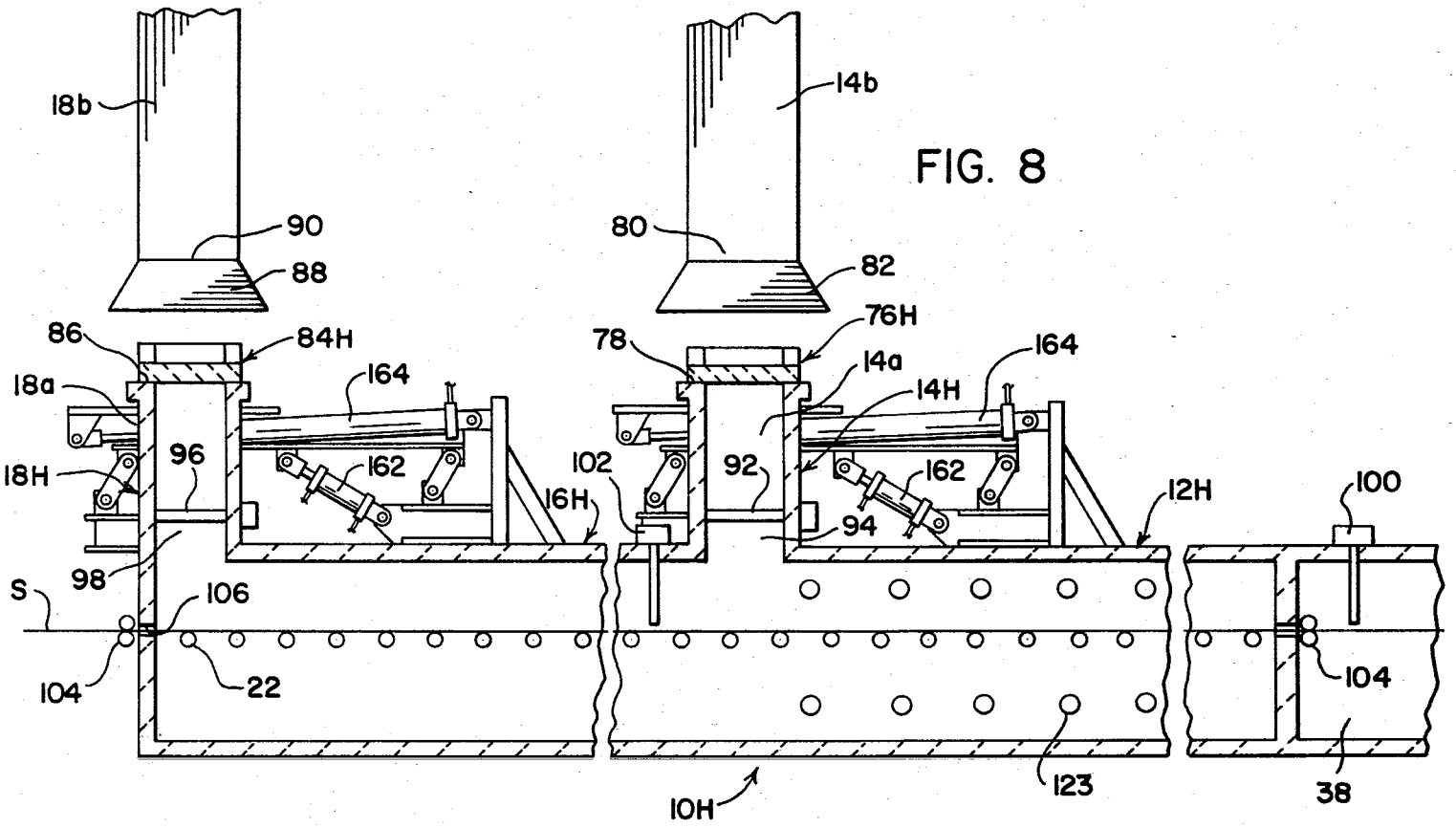
FIG. 8 is a schematic elevational view in section of another preferred embodiment of the invention.

Reference is now made to FIG. 8, wherein is shown a horizontal unfired preheat chamber 16H connected in tandem to a horizontal fired preheat chamber 12H. Since both chambers are horizontal and coplanar, the cross-over tunnels 26 and 107 of FIG. 1 are not necessary. Exhaust stacks 14H and 18H of FIG. 8 are substantially identical to exhaust stacks 14 and 18 of FIG. 1 in structure and operation, like parts are, accordingly, identified by like numerals. Strip support rolls 22H are positioned sufficiently close together to provide adequate support to the strip throughout the preheat furnace 10H. The method of operation of preheat furnace 10H is essentially the same as the method of operation of preheat furnace 10.

Figure 9:
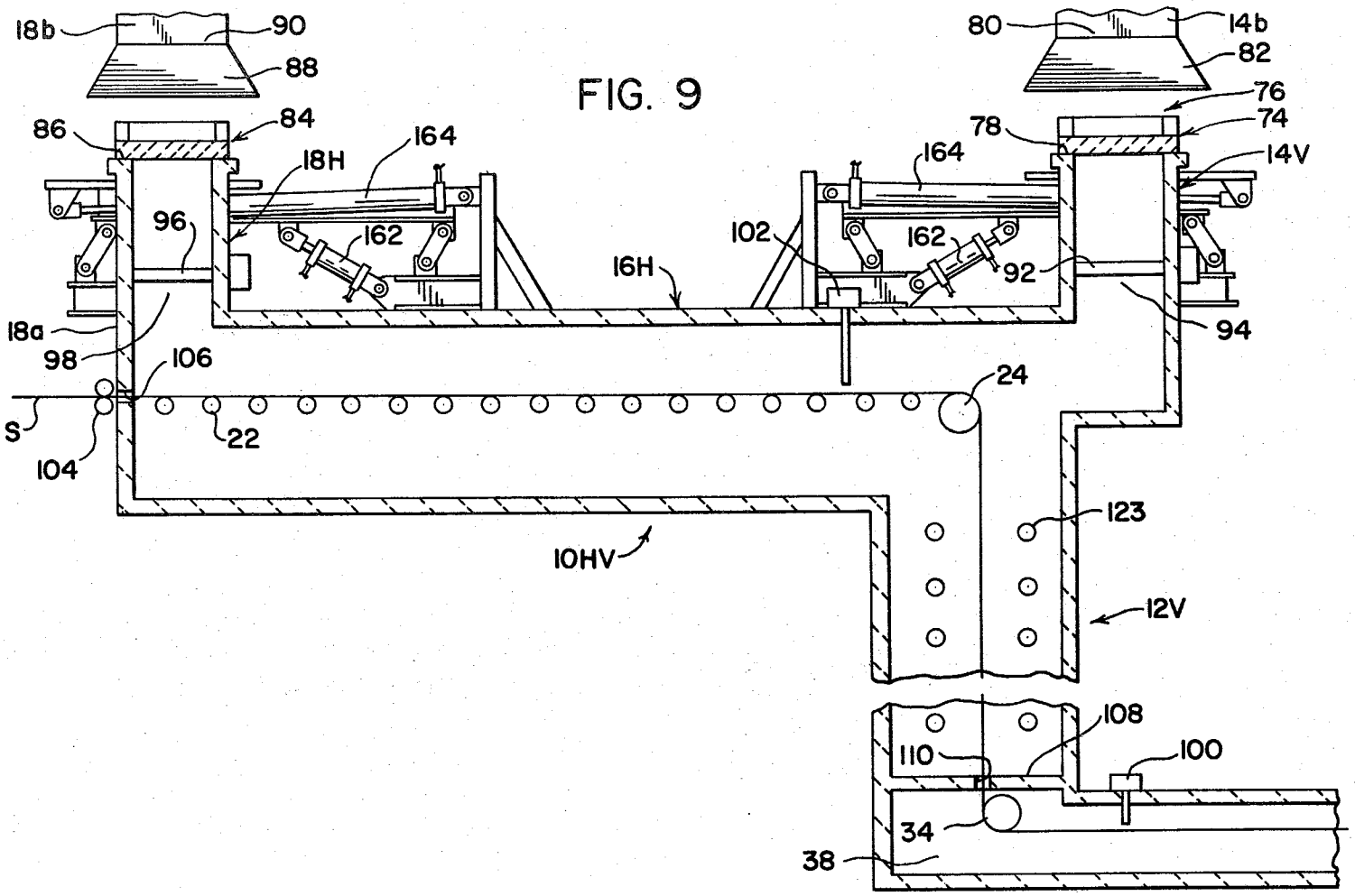
FIG. 9 is a schematic elevational view in section of yet another preferred embodiment of the invention.

Reference is next made to FIG. 9, wherein is shown a horizontal unfired preheat chamber 16H connected to a vertical fired preheat chamber 12V. No cross-over tunnels 26 and 107 are necessary in this embodiment of the invention either since the juncture of chamber 16H and chamber 12V serves this purpose. Exhaust stacks 14V and 18H of FIG. 9 are substantially identical to exhaust stacks 14 and 18 of FIG. 1 in structure and operation and like parts are, accordingly, identified by like numerals. The method of operation of preheat furnace 10HV is essentially the same as the method of operation of preheat furnace 10.

Figure 10:
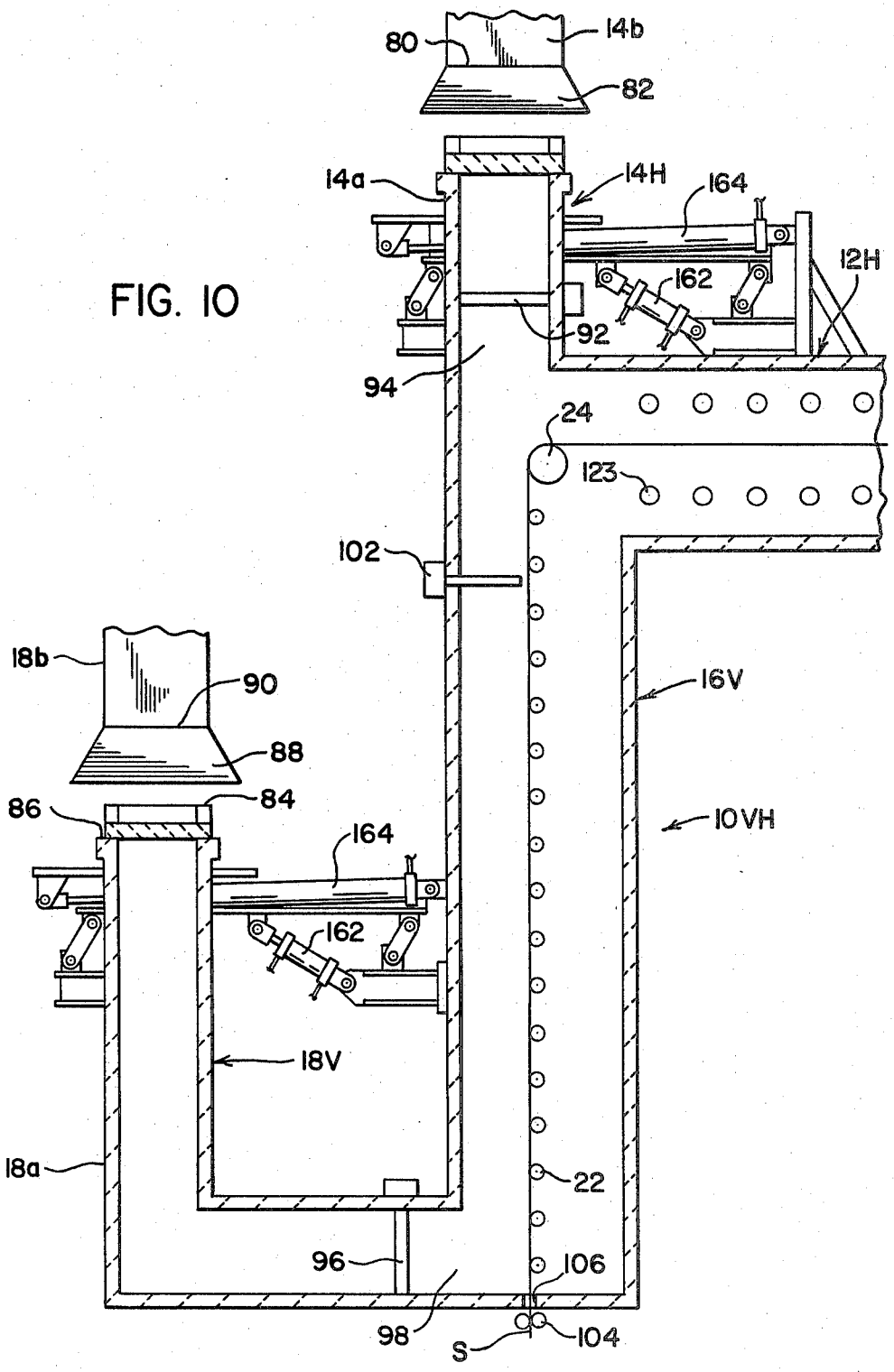
FIG. 10 is a schematic elevational view in section of an embodiment of the invention similar to FIG. 9, but with heating chambers rotated 90° from the heating chambers shown in FIG. 9; and, FIG. 11 is a schematic diagram illustrative of control means to operate the preferred embodiments of the invention.

FIG. 10 shows a preheat furnace 10VH which is a modified version of preheat furnace 10HV. In this embodiment a vertical unfired preheat chamber 16V is connected to a horizontal fired preheat chamber 12H. Exhaust stacks 14H and 18V are substantially identical to exhaust stacks 14 and 18 of FIG. 1 in structure and operation and like parts are, accordingly, identified by like numerals. The method of operation of preheat furnace 10VH is essentially the same as the method of operation of preheat furnace 10.

Operation of the Furnace

In a preferred embodiment of the subject preheat furnace, the fired preheat chamber is operated in the temperature range of 2200° F. to 2400° F., which is sufficient to clean the strip of impurities, such as oils and the like, accumulated during the rolling of the strip. The temperature of the flue gases, therefore, enter the unfired preheat section 16 within this range by means of a cross-over tunnel 26 and exit the flue stack 18 at a temperature of approximately 1000° F. Thus, the average temperature of the unfired preheat chamber is between 1600° F. and 1700° F. This indicates a recovery of 1200° F. to 1400° F. temperature from the exhaust gases before discharge through the exhaust stack 18.

Assuming that the temperature of the strip exiting from the fired preheat chamber is 1000° F., and assuming that the strip runs at a constant speed through the furnace then, depending on the gauge of the strip, adjustments may be made with dampers 92 and 96, and flue covers 76 and 84 to obtain any particular desired condition of the strip as it exits the preheat furnace. The addition of the unfired preheat chamber in tandem with a fired preheat chamber increases the efficiency of the operation of the furnace by approximately thirty percent because of the heat recovery in the unfired preheat chamber prior to exhausting the flue gases out the exhaust stack 18. Nevertheless, the ultimate test of the efficiency of a furnace is the condition of the strip as it enters the molten metal coating pot 72. Thus, if for any reason the surface of the strip is not proper, the molten coating will not properly adhere to the strip, thereby indicating a possible improper operation of the preheat furnace. For instance, by passing the strip through a flue heated unfired preheat chamber at temperatures between 1000° F. and 1700° F., conditions could be present wherein the impurities, such as oil, rather than being burned off the strip will actually be baked on the strip with such permanency that it cannot be removed by flame in the fired preheat chamber. Also, there could be a possibility that the strip in the unfired preheat tunnel might oxidize if its residency time is too long. However, by sensing the temperature of the strip with sensor 102 in cross-over tunnel 26, and exit strip temperature by sensor 100 in cross-over tunnel 38, proper adjustments of dampers 92, 96 and flue covers 76, 84 can be made. In accordance with these general observations, methods of operation of the preheat furnace have been developed wherein these methods may be categorized into three general modes as follows.

Mode 1

If the gauge of the strip is sufficiently heavy, strip will be submitted to a full preheat treatment wherein, under run conditions, damper 92 and flue cover 74 are fully closed, flue cover 84 is fully opened and damper 96 is adjusted to maintain a predetermined pressure within the preheat furnace. With these controls properly adjusted, the heating of the strip is maximized, the only limitation being the desired temperature of the strip exiting from the fired preheat chamber. Under this mode of operation, within a predetermined range of strip gauges, the furnace can run at its designed optimum speed with burners 123 operating at their maximum capacity. This mode will produce the maximum tonnage of strip per unit of time.

Mode 2

For lighter gauge strip, which cannot tolerate a maximum preheat, a predetermined optimum temperature in cross-over tunnel 26 may be obtained by proper adjustment of damper 92 and flue cover 76 to provide a partial bypass of flue gases. With flue covers 76 and 84 open, and damper 92 partially open, damper 96 is adjusted to control the furnace pressure. If the furnace pressure drops below a predetermined set point, damper 96 and flue cover 84 will close and damper 92 will be used for controlling the pressure in the furnace.

By way of example, assume a preheat furnace with a rated capacity of forty tons of steel per hour; a strip speed of three-hundred feet per minute; the fired preheat section operating in a temperature range between 2200° F. and 2400° F, the temperature of the flue gases leaving the exhaust stack 18 at approximately 1000° F., and with the strip leaving the fired preheat section at approximately 1000° F. It has been determined that if the temperature of the strip in cross-over tunnel 26 can be controlled to within approximately 600° F. to 700° F., then the surface of the strip will be satisfactorily prepared for subsequent coating such as by galvanizing or by other ferrous metal coating. Thus, by controlling the temperature in cross-over tunnel 26, it has been found that this control generally guarantees that the entire preheating of the strip will be satisfactory.

When the temperature at sensor 102 is noted to be less than the desired set point, the furnace is operated in accordance with Mode 1 until the temperature sensed by sensor 102 indicates that the temperature of the strip is back to the predetermined set point.

When the temperature sensed by sensor 102 is within permissible limits, damper 92 is opened sufficiently to provide a degree of bypass, but not a complete bypass, while damper 96 will be adjusted to control furnace pressure. If during operation in accordance with Mode 2, the furnace pressure drops below the desired set point, then damper 96 will close together with flue cover 84. Variable adjustments of the damper 92 will be made to maintain furnace pressure and temperature at sensor 102 within controlled limits.

Mode 3

For heat treating the narrowest gauges, the flue gases must be severely restricted in the unfired preheat section 16 to prevent the strip from becoming overheated. If the temperature at sensor 102 exceeds the desired set point temperature for narrow gauges, damper 96 and flue cover 84 are closed, flue cover 76 is opened and damper 92 is variably adjusted to control furnace pressure.

In general, flue covers 76 and 84 are only closed in the event of a line stop, or when dampers 92 and 96 are closed or, in the event of a power failure, to back up the closing of dampers 92 and 96. However, there is a time delay in the closing of damper 84, wherein damper 84 is kept open during purging following a line stop, such as taught in U.S. Pat. No. Re. 28,168. Upon completion of the purge operation, flue cover 74 will again close.

Figure 11:
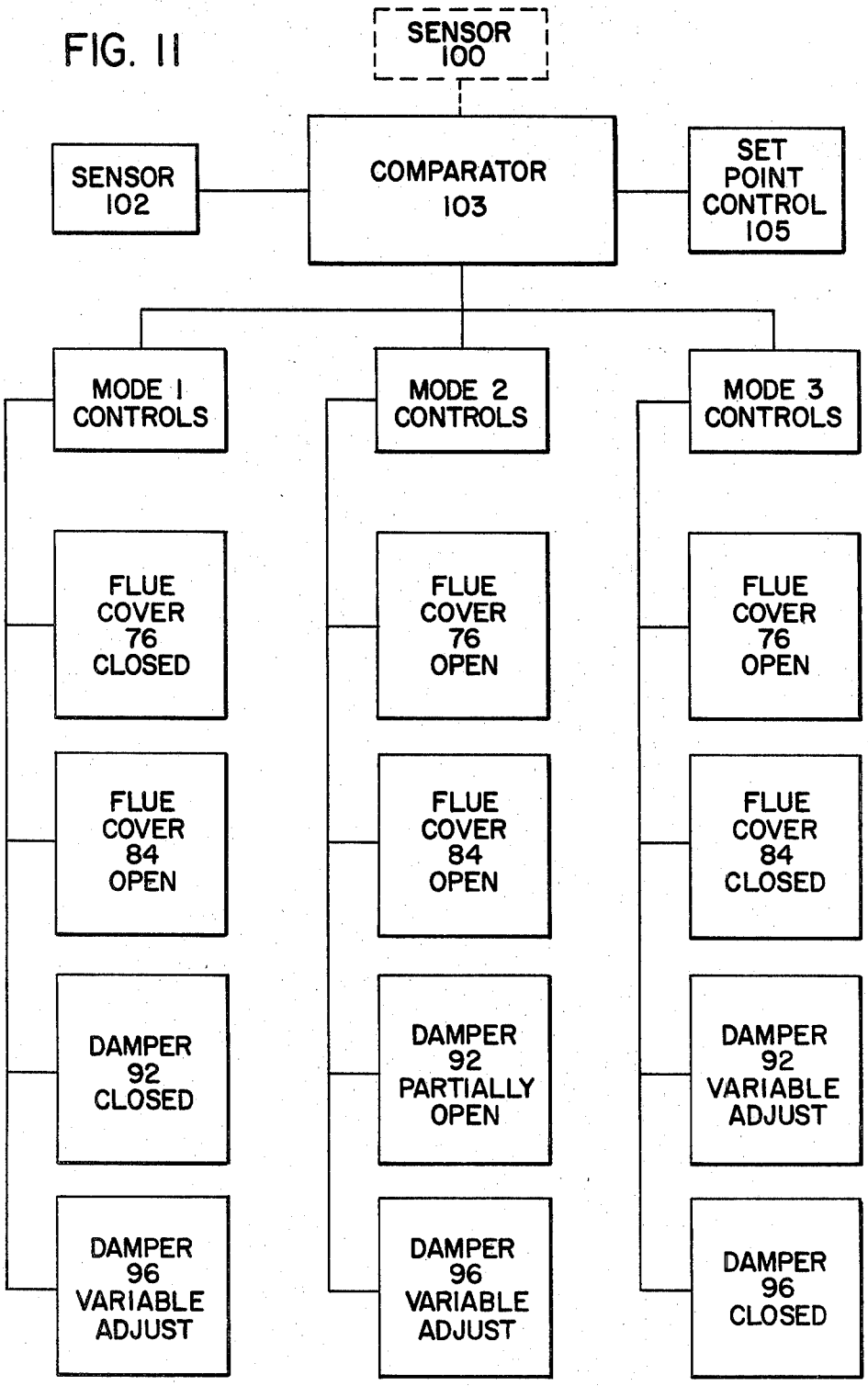

Reference is now made to FIG. 11, wherein is shown a schematic diagram of one illustrative arrangement of control means to operate the embodiments of the furnace heretofore described. The actual circuitry and selection of electrical and electronic controls and related electrical devices is a matter of choice. Other arrangements and systems will come to mind and are well within the competence of those skilled in the art following a study of the specification, drawings and claims of this application.

The operation of the subject invention contemplates sensing the temperature of the strip in at least one location of the preheat furnace 10 by sensor 102. The temperature sensed is fed to a comparator 103 which also receives a signal from the set point control 105 indicating what the desired temperature should be. The signals from sensor 102 and set point control 105 are compared and, if there is a difference, the difference is recognized and categorized and an appropriate signal is relayed to one of the three mode controls previously selected by the furnace operator and connected to the comparator. The selected mode control is adapted to maintain the proper relationship between the two dampers and the two flue covers so as to establish, maintain and/or adjust the temperature at sensor 102 to match the temperature called for by the set point control 105. This is a dynamic process which continuously signals the damper and flue cover actuator drives to respond depending on the particular signal from the comparator.

By way of example, if heavy gauge strip is being run through the preheat furnace, the operator connects the comparator to the Mode 1 controls. These controls are adapted to energize suitable drive actuators which in turn actuate drive means to close flue cover 76, open flue cover 84, close damper 92 and to continuously adjust damper 96 responsive to the algebraic sum of the signal outputs from the sensor 102 and the set point control 105.

When medium gauge strip is being processed, the Mode 2 controls are connected to the comparator 103, wherein appropriate signals are relayed to drive means which open flue cover 76, open flue cover 84, partially open damper 92 and continuously adjust damper 96 to obtain and maintain the desired temperature reading at sensor 102.

In the case of light gauge strip, Mode 3 controls are connected to comparator 103 from which appropriate signals are generated to actuate drive means that open flue cover 76, close flue cover 84, close damper 96 and continuously adjust damper 92.

With certain types of strip and under certain operating conditions a sensing of strip temperatures at more than one location may be desirable. In which case, additional sensors, such as symbolically indicated by sensor 100, are used to relay temperature readings to the comparator 103. These readings are analyzed relative to the set point control signal and either an algebraic composite signal is forwarded to the appropriate mode controls or a plurality of signals are forwarded to the mode controls to command two or more simultaneous or sequential acts. For instance, in the case of Mode 2 operation, instead of damper 92 being partially opened, it may be ordered to close, open wider or variably adjust in coaction with damper 96. Thus, with the system described the combinations of adjustments available to fine tune the furnace are virtually limitless. The adjustments discussed in association with FIG. 11 are merely illustrative of the furnace operational methods available to the furnace operator to obtain maximum furnace efficiency and work product quality. Within the teaching and scope of the invention, it will be understood that these methods will vary depending on the product being processed.

Summation

The purposes of the just described invention are to improve the operating efficiency of a preheat furnace and to enable the furnace to process a wider range of gauges of high quality steel strip. With the operation of the furnace as described in Modes 1 and 2, the efficiency of operation is improved approximately thirty percent. Thus, for example, for each 1000 BTU normally consumed by a prior art preheat furnace, only about 300 BTU are useful for preheating purposes, the other 700 BTU being lost through wall surfaces and out flues. The subject invention has been found to operate usefully utilizing about 500 BTU of each 1000 BTU consumed by the proper control of flues and dampers as described. Thus, there is considerable economy in recovering heat in the unfired preheat section of the preheat furnace by lowering the temperature of the exhaust flue gas approximately 1200° F. By lowering and controlling the exit temperature of the flue gases out the unfired preheat section exhaust stack, this efficiency of the subject invention has been obtained. The difference in flue gas temperature between 2200° F., leaving the fired preheat section, and 1000° F., leaving the unfired preheat section flue gas exhaust stack, times the flue gas products in pounds equals the recovery heat which otherwise would have been wasted and exhausted out through the exhaust stack 18.

The full preheat operation Mode 1 is the most desirable method of operating the subject preheat furnace in that it yields the maximum full efficiency and maximum production. The second most desirable means of operating the preheat furnace is in accordance with Mode 2 which requires a controlled amount of heat at sensor 102 plus some bypassing operation at damper 92 and some pressure control at damper 96. The least efficient operation is Mode 3 wherein, because of the lightness of the gauge of the strip, it is necessary to operate the preheat furnace with flue cover 74 fully open which effectively shuts down the operation of the unfired preheat chamber 16. Nevertheless, it is commercially attractive to operate the subject invention by Mode 3 for lighter gauges when the alternative is the requirement to make a heavy capital goods investment in a separate light gauge preheat furnace and galvanizing line.

Having now described preferred embodiments of the invention, it will be clear to those skilled in the art that additional embodiments, modifications and improvements may be made without departing from the intended scope of the invention as defined in the appended claims.

Having thus described the invention, it is claimed:

1. A continuous strip preheat furnace comprising: a first flue gas exhaust stack; an unfired preheat chamber; a first flue gas throat connecting said first flue gas stack to said unfired preheat chamber; a fired preheat chamber connected to said unfired preheat chamber; roll means to guide continuous strip through said unfired preheat chamber and through said fired preheat chamber; a second flue gas exhaust stack connected to said fired preheat furnace; a second flue gas throat connecting said fired preheat chamber with said second flue gas exhaust stack; a first damper in said first flue gas throat; a second damper in said second flue gas throat; first flue cover means to open and to close said first flue gas exhaust stack; second flue cover means to open and to close said second flue gas exhaust stack; sensor means to detect the temperature of said strip passing through said preheat furnace, and means to adjust said dampers and said flue covers responsive to temperature detection by said sensor means.

2. The device of claim 1, wherein said flue cover means comprises: a flue cover; means to lower and raise said flue cover over its exhaust stack; and means to laterally shift said flue cover toward and away from said exhaust stack, said lowering means being adapted to bring said flue cover into tight shut off sealing engagement with said exhaust stack.

3. The device of claim 1, wherein said flue cover means comprises: a flue cover adapted to be transported on track means; means to shift said flue cover on said track means toward and away from said exhaust stack, and means to shift said track means upwardly and downwardly.

4. The device of claim 1, wherein said first and second exhaust stacks are bifurcated and said first and second flue cover means are adapted to seal the lower of said bifurcated portions of said exhaust stacks, the improvement in each of said flue cover means comprising: an insulated flue cover; stanchions secured to said flue cover and extending downwardly therefrom; wheels secured to the lower ends of said stanchions; track means positioned on opposite sides of said lower of said bifurcated flue stack portions and extending laterally to one side thereof sufficient to permit said flue cover to be shifted laterally clear of the upper end of said lower portion of said bifurcated flue stack, said track means being adapted to receive said wheels thereon; means to laterally shift said flue cover on said tracks; means to selectively shift said tracks downwardly and upwardly, whereby said flue cover may be selectively lowered into tight sealing engagement with, and raised upwardly out of tight sealing engagement from, said lower portion of said bifurcated flue stack.

5. In a preheat furnace comprising a first flue gas exhaust stack; an unfired preheat chamber; a first flue gas throat connecting said first flue gas stack to said unfired preheat chamber; a fired preheat chamber; roll means to guide continuous strip through said unfired preheat chamber and through said fired preheat chamber; a second flue gas exhaust stack connected to said fired preheat furnace; a second flue gas throat connecting said fired preheat chamber with said second flue gas exhaust stack; a first damper in said first flue gas throat; a second damper in said second flue gas throat; first exhaust stack flue cover means to open and to close said first flue gas exhaust stack; second exhaust flue cover means to open and to close said second exhaust stack, the method of operating said preheat furnace comprising the steps of:

(1) heating said fired preheat chamber with open flame burners to within a predetermined temperature range;
(2) permitting the flue gases from said open flame burners to pass through said unfired preheat chamber;
(3) passing continuous strip through said preheat furnace counter to the flow of said flue gases;
(4) closing said second damper;
(5) closing said second flue cover;
(6) opening said first flue cover;
(7) variably adjusting said first damper to maintain a predetermined pressure in said preheat furnace;
(8) sensing the temperature of the strip as it passes from said unfired preheat chamber to said fired preheat chamber;
(9) adjusting said dampers and said flue covers to maintain predetermined strip temperatures.

6. The method of operating a preheat furnace as set forth in claim 5, wherein (1) said fired preheat chamber is heated to within a temperature range of substantially 2200° F. to 2400° F.;

(2) the temperature of the strip entering said preheat furnace is maintained within a temperature range of substantially 600° F. to 700° F.; and, (3) the temperature of the strip exiting from said preheat furnace is maintained at substantially 1000° F.

7. In a preheat furnace comprising a first flue gas exhaust stack; an unfired preheat chamber; a first flue gas throat connecting said first flue gas stack to said unfired preheat chamber; a fired preheat chamber; roll means to guide continuous strip through said unfired preheat chamber and through said fired preheat chamber; a second flue gas exhaust stack connected to said fired preheat chamber; a second flue gas throat connecting said fired preheat chamber with said second flue gas exhaust stack; a first damper in said first flue gas throat; a second damper in said second flue gas throat; first exhaust stack cover means to open and to close said first flue gas exhaust stack; second exhaust stack cover means to open and to close said second exhaust stack, the method of Mode 1 operation of said preheat furnace comprising the steps of:

(1) heating said fired preheat chamber with open flame burners to within a predetermined temperature range;

(2) permitting the flue gases from said open flame burners to pass through said unfired preheat chamber;

(3) sensing the temperature of the strip before it passes through said fired preheat chamber;

(4) closing said second damper; closing said second flue cover; opening said first flue cover; and variably adjusting said first damper to maintain a predetermined pressure in said furnace.

8. The method of claim 7, including selectively the method of Mode 2 operation comprising the steps of: partially opening said second damper; opening said first and second flues; and variably adjusting said first damper to maintain a predetermined furnace pressure.

9. The method of claim 8, including selectively the method of Mode 3 operation comprising the steps of: closing said first flue cover, opening said second flue cover; closing said first damper and variably adjusting said second damper to maintain a predetermined furnace pressure.

10. The method of operating a preheat furnace as set forth in claim 7, wherein:

(1) said fired preheat chamber is heated to within a temperature range of substantially 2200° F. and 2400° F.;

(2) the temperature of the strip entering said fired preheat chamber is maintained within a temperature range of substantially 600° F. to 700° F.; and, (3) the temperature of the strip exiting said fired preheat chamber is maintained at a temperature of substantially 1000° F.

11. A continuous strip preheat furnace comprising: a first vertical flue gas exhaust stack; a vertical unfired preheat chamber; a first flue gas throat connecting the lower end of said first flue gas exhaust stack to the lower end of said unfired preheat chamber; a vertical fired preheat chamber; a first tunnel connecting the upper end of said unfired preheat chamber to the upper end of said fired preheat chamber; a second tunnel superposed on said first tunnel; means for continuous strip ingress and egress through said second tunnel; roll means to guide continuous strip vertically upwardly through said unfired preheat chamber, horizontally through said second tunnel, and vertically downward through said fired preheat chamber; a second vertical flue gas exhaust stack adjacent the upper end of said fired preheat furnace; a second flue gas throat connecting said fired preheat chamber with said second flue gas exhaust stack; a first damper in said first flue gas throat; a second damper in said second flue gas throat; first flue cover means to open and to close said first flue gas exhaust stack; second flue cover means to open and to close said second flue gas exhaust stack; a first strip heat sensor located in said second tunnel; and means to adjust said dampers and said flue covers responsive to said first strip heat sensor temperature readings in said second tunnel.

12. The device of claim 11, wherein said first and second tunnels are rigidly secured to said fired preheat chamber and extend in cantilever fashion over the upper periphery of said unfired preheat chamber; and bellows means connecting said upper periphery of said unfired preheat chamber to the underside of said cantilevered first tunnel, said bellows means sealing the interface between said unfired preheat chamber and said first tunnel against ingress of ambient atmosphere.

13. The device of claim 12, including resilient means to support the cantilevered end of said cantilevered first tunnel.

14. In a fired vertical preheat furnace, the improvement comprising: a fired vertical preheat chamber; an exhaust stack operatively connected to the upper end of said fired preheat chamber; an unfired vertical preheat chamber operatively connected to the upper end of said fired vertical preheat chamber; an exhaust stack operatively connected to the lower end of said unfired vertical preheat chamber; and means to coordinate the regulation of flue gas emissions through said exhaust stacks to regulate the temperature of continuous strip passing through said vertical preheat furnace and to maximize the utilization of said flue gas to preheat said strip.

15. In a preheat furnace having a fully enclosed strip pass line, an unfired preheat chamber in contiguous communication with a fired preheat chamber, a flue gas exhaust stack secured to each of said chambers; and a temperature responsive adjustable damper and an adjustable exhaust stack cover for each of the exhaust stacks to selectively exhaust flue gases from said exhaust stack.

16. In a preheat furnace, the improvement comprising: a fired preheat chamber; an exhaust stack operatively connected to said fired preheat chamber; an unfired preheat chamber operatively connected to said fired preheat chamber; an exhaust stack operatively connected to said unfired preheat chamber; temperature sensing means; and means responsive to said temperature sensing means to coordinate the regulation of flue gas emissions through said exhaust stack to regulate the temperature of continuous strip passing through said preheat furnace and to maximize the utilization of said flue gas to preheat said strip.

17. The preheat furnace of claim 16, including sensor means adapted to sense the temperature of strip passing through the connection between said fired and unfired chambers.

18. The preheat furnace of claim 16, including an adjustable damper in each of said exhaust stacks; an adjustable flue cover on each of said exhaust stacks; and means to adjust said dampers and said flue covers adapted to be coordinated by said coordinate means.

19. In a continuous strip preheat furnace having a flue gas exhaust stack, an exhaust stack flue cover structure comprising: a frame of sufficient size to cover the opening of said exhaust stack and adapted to encase insulation of the type sufficient to withstand flue gas heat; a flue cover plate to support said insulation and to provide a tight seal with said exhaust stack opening; stanchions secured to opposite sides of said frame and adapted to extend downwardly on corresponding opposite sides of said exhaust stack; wheel means secured to the lower extremities of said stanchions; channel members positioned on said exhaust stack opposite sides beneath said stanchions to engage said wheels in supporting relationship therewith; parallel link means pivotally secured to said exhaust stack opposite sides and to the opposite ends of said channel members; means to arcuately shift said link means to raise and to lower said channel members; means to horizontally shift said flue cover structure on said channel members to cover and uncover said exhaust stack opening when said channel members are in the raised position; and said cover plate being adapted to form a tight seal with the exhaust stack opening when said flue cover plate is lowered into contact with said exhaust stack opening upon the lowering of said channel members.

20. In a continuous strip preheat furnace having a flue gas exhaust stack, an exhaust stack flue cover structure comprising: a frame of sufficient size to cover the opening of said exhaust stack and adapted to encase insulation of the type sufficient to withstand flue gas heat; a flue cover plate to support said insulation and to provide a tight seal with said exhaust stack opening; roller means secured to opposite sides of said frame; channel members positioned on opposite sides of said exhaust stack to engage said roller means in supporting and rolling relationship therewith; linkage means positioned on opposite sides of said exhaust stack and to the opposite ends of said channel members; means to shift said linkage means to raise and to lower said channel members; means to horizontally shift said flue cover structure on said channel members to cover and uncover said exhaust stack opening when said channel members are in the raised position; and said cover plate being adapted to form a tight seal with the exhaust stack opening when said flue cover plate is lowered into contact with said exhaust stack opening upon the lowering of said channel members.

21. In a continuous strip preheat furnace having a flue gas exhaust stack, an exhaust stack flue cover structure comprising: a flue cover to provide a tight seal with said exhaust stack opening; channel members positioned on said exhaust stack opposite sides beneath said flue cover in supporting relationship therewith; vertical shifting means secured to said exhaust stack opposite sides and to said channel members; means to energize said shifting means to sequentially raise and to lower said channel members; means to horizontally shift said flue cover on said channel members to cover and uncover said exhaust stack opening when said channel member are in the raised position; and said flue cover being adapted to form a tight seal with the exhaust stack opening when said flue cover is lowered into contact with said exhaust stack opening upon the lowering of said channel members.

22. In a continuous strip preheat furnace having a flue gas exhaust stack, an exhaust stack flue cover structure comprising: temperature sensing means; a flue cover to provide a tight seal with said exhaust stack opening; means to raise and to lower said flue cover; means to horizontally shift said flue cover to close and to open said exhaust stack opening when said flue cover is in the raised position, said flue cover being adapted to form a tight seal with the exhaust stack opening when said flue cover is lowered into contact with said exhaust stack opening, and said means to raise, lower and horizontally shift said flue cover being responsive to said temperature sensing means.

23. In a continuous strip preheat furnace having a flue gas exhaust stack and an orifice in said exhaust stack to exhaust flue gases, the method of opening and closing said exhaust stack orifice during normal running operation of said furnace comprising the steps of:

(1) positioning a flue cover to one side of said orifice;
(2) sensing a first temperature in said continuous strip preheat furnace;
(3) shifting said flue cover to a position directly over said orifice and then lowering said flue cover into gas tight contact with said orifice responsive to said first temperature sensing;
(4) sensing a second temperature in said continuous strip preheat furnace; and
(5) shifting said flue cover upwardly and then horizontally to uncover said orifice responsive to said second temperature sensing.

* * * * *